US010876768B2

(12) United States Patent
Schoneboom

(10) Patent No.: US 10,876,768 B2
(45) Date of Patent: Dec. 29, 2020

(54) SCREW COMPRESSOR FOR HVAC

(71) Applicant: DENSO International America, Inc., Southfield, MI (US)

(72) Inventor: Sean Schoneboom, Bronson, MI (US)

(73) Assignee: DENSO International America, Inc., Southfield, MI (US)

( * ) Notice: Subject to any disclaimer, the term of this patent is extended or adjusted under 35 U.S.C. 154(b) by 237 days.

(21) Appl. No.: 16/137,788

(22) Filed: Sep. 21, 2018

(65) Prior Publication Data

US 2020/0096235 A1 Mar. 26, 2020

(51) Int. Cl.

| | |
|---|---|
| ***F04C 18/16*** | (2006.01) |
| ***F25B 1/047*** | (2006.01) |
| ***F04C 18/12*** | (2006.01) |
| ***F04C 29/00*** | (2006.01) |

(52) U.S. Cl.

CPC ..... *F25B 1/047* (2013.01); *F04C 18/123* (2013.01); *F04C 18/165* (2013.01); *F04C 29/005* (2013.01); *F04C 29/0042* (2013.01); *F04C 18/16* (2013.01); *F04C 2220/00* (2013.01); *F04C 2240/30* (2013.01)

(58) Field of Classification Search

CPC ..... F04C 18/123; F04C 18/16; F04C 18/165; F04C 29/0042; F04C 2220/00; F04C 29/005; F04C 29/0021; F04C 29/04; F04C 2240/30; F04C 2240/80; F04C 2240/805; F04C 2240/806; F01C 21/007; F02C 2230/60; F25B 1/047

See application file for complete search history.

(56) References Cited

U.S. PATENT DOCUMENTS 2,575,154 A * 11/1951 Zoll ..... F04C 11/001 418/199
2,693,762 A * 11/1954 Sennet ..... F02B 53/00 418/197
4,220,197 A 9/1980 Schaefer et al.
5,533,887 A * 7/1996 Maruyama ..... F04C 18/084 277/345

(Continued)

FOREIGN PATENT DOCUMENTS

KR 101605073 B1 3/2016

OTHER PUBLICATIONS

"One Female More Change the World of Screw Compressors for Oil and Water Injected Screw Compressors" by Guenter Kirsten (COO at UNO International Inventments INC), Published on Mar. 5, 2017, https://www.linkedin.com/pulse/one-female-more-change-world-screw-compressors-oil-water-kirsten/.

(Continued)

*Primary Examiner* — Patrick Hamo
*Assistant Examiner* — Joseph S. Herrmann
(74) *Attorney, Agent, or Firm* — Harness, Dickey & Pierce, P.L.C.

(57) ABSTRACT

A screw compressor for a heating, ventilation, and air conditioning (HVAC) system. The screw compressor includes a housing having an inlet end and an outlet end for refrigerant to pass into and out of the housing. A motor is within the housing. A plurality of screw sets are arranged about the motor. The screw sets receive refrigerant entering through the inlet, compress the refrigerant between meshed rotors of the plurality of screw sets, and direct refrigerant out of the housing through the outlet end of the housing.

20 Claims, 4 Drawing Sheets

(56) References Cited

U.S. PATENT DOCUMENTS

| | | | | |
|---|---|---|---|---|
| 5,979,168 | A | 11/1999 | Beekman | |
| 6,003,324 | A * | 12/1999 | Shaw | F04C 18/165 417/212 |
| 6,217,304 | B1 | 4/2001 | Shaw | |
| 6,478,560 | B1 * | 11/2002 | Bowman | F04C 23/001 418/1 |
| 7,178,352 | B2 * | 2/2007 | Lifson | F04C 18/165 418/196 |
| 7,980,836 | B2 * | 7/2011 | Shaw | F04C 18/165 418/190 |
| 8,205,469 | B2 * | 6/2012 | Tsuboi | F04C 18/16 62/498 |
| 2018/0363650 | A1 * | 12/2018 | Kikuchi | F04C 23/001 |

OTHER PUBLICATIONS

"New Development for an Three Rotor Screw Compressor with Poly-Ceramic Rotors" by Guenter Kirsten (COO at UNO International Investments INC), Published on Mar. 9, 2016, https://www.linkedin.com/pulse/new-development-three-rotor-screw-compressor-rotors-guenter-kirsten/.

"Small Screw Compressors for Automobile Air Conditioning Systems" by Y. Fukazawa and U. Ozawa, Published in 1980, https://docs.lib.purdue.edu/cgi/viewcontent.cgi?referer=https://www.google.com/&httpsredir=1&article=1350&context=icec.

"Variable Speed Tri-Rotor Screw Compression Technology" by Ko Young Ye, Published in 2006, https://docs.lib.purdue.edu/cgi/viewcontent.cgi?article=2824&context=icec.

* cited by examiner

SCREW COMPRESSOR FOR HVAC

FIELD

The present disclosure relates to a screw compressor for a heating, ventilation, and air conditioning system (HVAC), such as a vehicle HVAC.

BACKGROUND

This section provides background information related to the present disclosure, which is not necessarily prior art.

While current heating, ventilation, and air conditioning (HVAC) system compressors are suitable for their intended use, they are subject to improvement. For example, there is a need for a compressor which, when compressing refrigerant: does not increase the temperature of the refrigerant as much as a piston compressor does; reduces pulsation and spill-back of refrigerant as compared to a piston compressor; and has a lower level of overload requirements as compared to a piston compressor. The present disclosure advantageously provides for compressors that address these needs in the art, as well as numerous others as described herein and as one skilled in the art will appreciate.

SUMMARY

This section provides a general summary of the disclosure, and is not a comprehensive disclosure of its full scope or all of its features.

The present disclosure includes a screw compressor for a heating, ventilation, and air conditioning (HVAC) system. The screw compressor includes a housing having an inlet end and an outlet end for refrigerant to pass into and out of the housing. A motor is within the housing. A plurality of screw sets are arranged about the motor. The screw sets receive refrigerant entering through the inlet, compress the refrigerant between meshed rotors of the plurality of screw sets, and direct refrigerant out of the housing through the outlet end of the housing.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
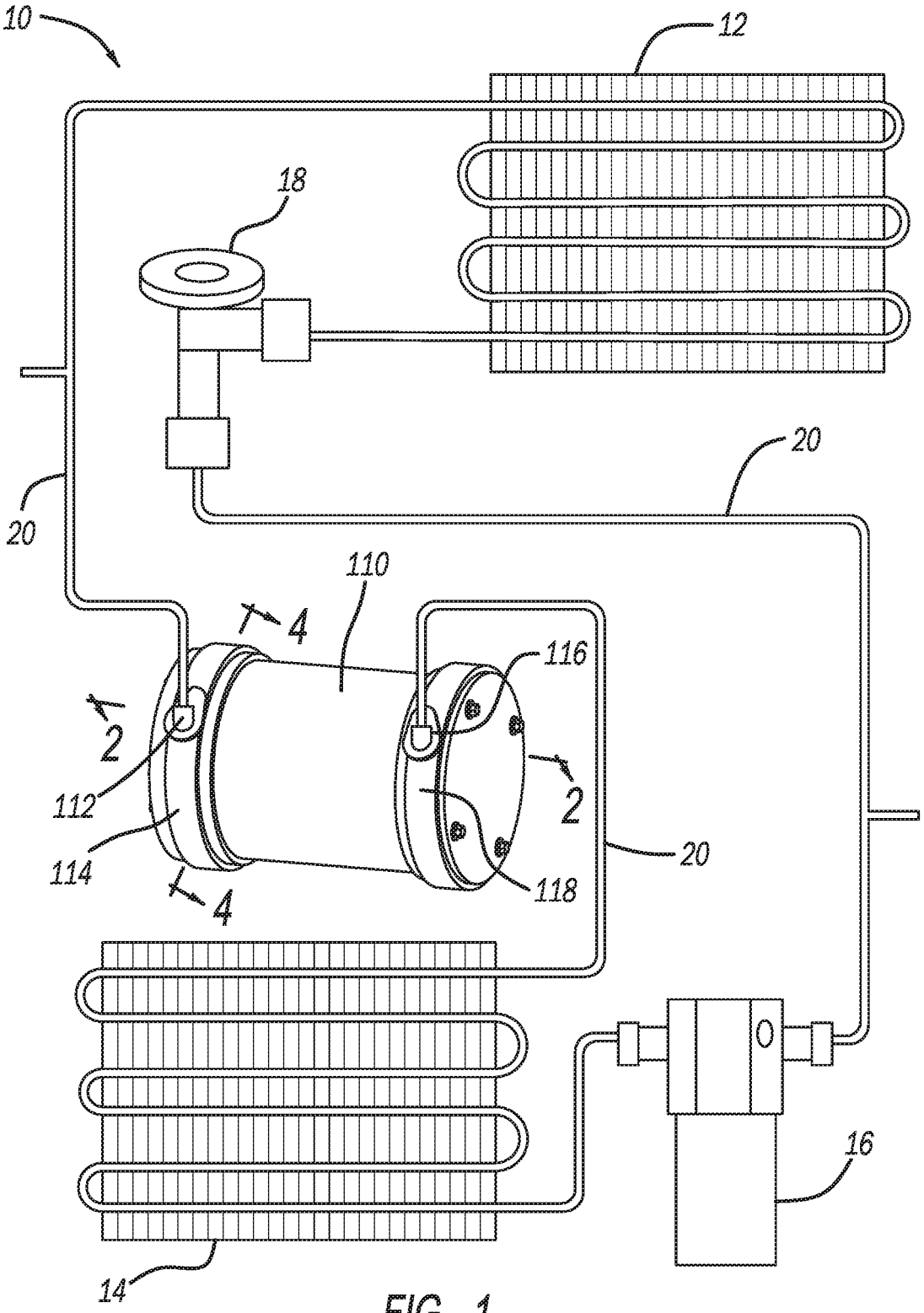
FIG. 1 illustrates an exemplary heating, ventilation, and air conditioning system (HVAC) including an exemplary compressor in accordance with the present disclosure.

FIG. 1 illustrates a compressor 110 in accordance with the present disclosure included with an exemplary heating, ventilation, and air conditioning (HVAC) system 10. The HVAC system 10 can be any suitable HVAC system, such as an HVAC system for a vehicle. Exemplary vehicles include passenger vehicles, mass transit vehicles, recreational vehicles, military vehicles/equipment, construction vehicles/equipment, watercraft, aircraft, etc. The compressor 110 may also be configured for use with any suitable non-vehicular HVAC system, such as a building HVAC system.

The exemplary HVAC system 10 includes an evaporator 12, a condenser 14, a dryer 16, and a thermal expansion valve 18. Any suitable refrigerant is circulated through the HVAC system 10 by way of a refrigerant line 20. From the evaporator 12, the refrigerant line 20 delivers refrigerant to an inlet 112 of the compressor 110. The inlet 112 is included with a rotatable inlet cylinder 114. The refrigerant enters the compressor 110 as a low pressure gas, which is compressed by the compressor 110 into a high pressure gas. The high pressure gas refrigerant exits the compressor 110 through an outlet 116 of a rotatable outlet cylinder 118. Advantageously, the inlet cylinder 114 and the outlet cylinder 118 are each rotatable, which allows the inlet 112 and the outlet 116 to be arranged at any suitable rotational position about the compressor 110 to facilitate connection of the refrigerant lines 20 to the inlet 112 and the outlet 116, and thus generally facilitate installation of the compressor 110 in the HVAC system 10.

The high pressure gas refrigerant flows from the compressor 110 to the condenser 14, where heat is radiated out from the refrigerant. At the condenser 14, the high pressure gas refrigerant condenses to a high pressure liquid refrigerant, which is dried at the dryer 16. From the dryer 16 the liquid refrigerant flows through the refrigerant line 20 to the thermal expansion valve 18, and back to the evaporator 12 as a low pressure liquid that absorbs heat from a vehicle passenger cabin, for example.

Figure 2:
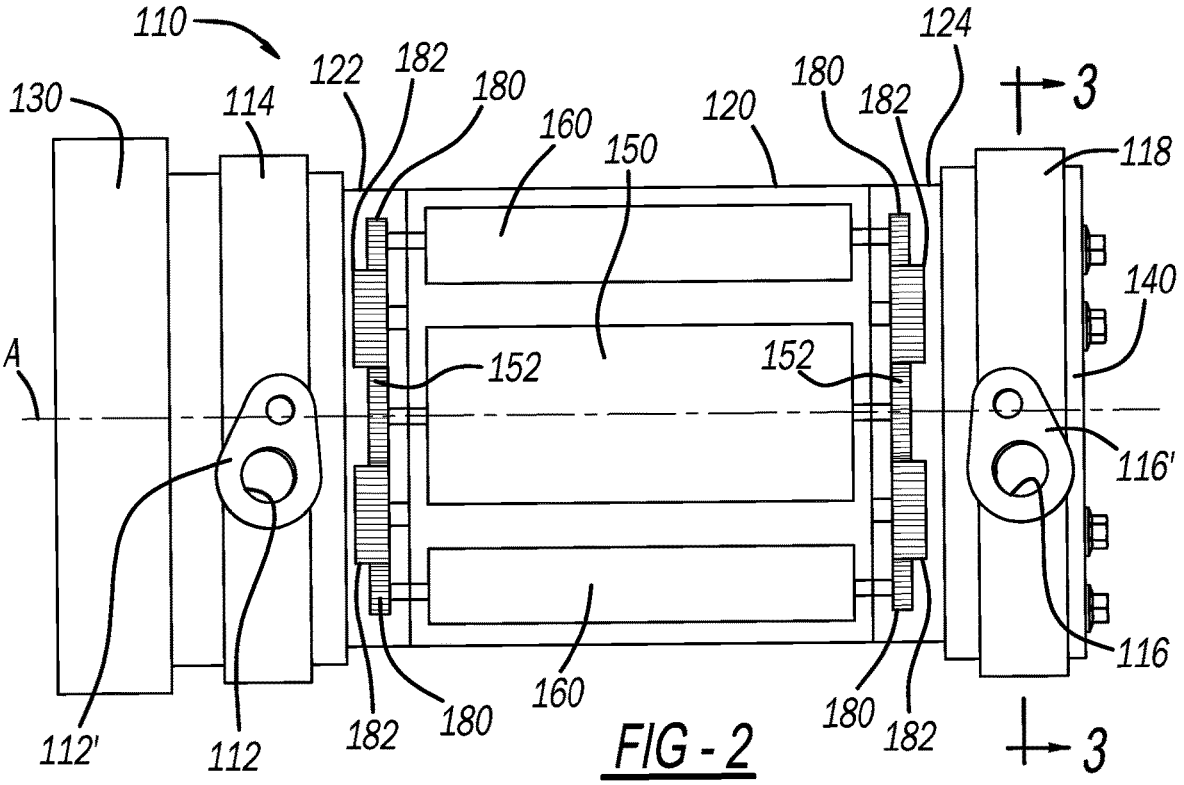
FIG. 2 is a cross-sectional view of the compressor of FIG. 1 taken along line 2-2 of FIG. 1.

With reference to FIG. 2, the compressor 110 will now be described in additional detail. The compressor 110 includes a housing 120, which is generally a circular, cylindrical housing having an inlet end 122 and an outlet end 124, which is opposite to the inlet end 122. A longitudinal axis A of the housing 120 extends along an axial center of the housing 120 between the inlet end 122 and the outlet end 124.

The inlet 112, which provides a refrigerant passageway into the rotatable inlet cylinder 114, is defined by a coupling member 112'. The coupling member 112' is rotatable independent of the rotatable inlet cylinder 114 (such as along an axis perpendicular to the longitudinal axis A) to provide further adjustability of the inlet 112 and further facilitate coupling of the refrigerant line 20 to the inlet 112 and the coupling member 112'. Similarly, the outlet 116 is defined by a coupling member 116'. The coupling member 116' is rotatable independent of the rotatable outlet cylinder 118 (such as along an axis perpendicular to the longitudinal axis A) to provide further adjustability of the outlet 116 and further facilitate coupling of the refrigerant line 20 to the outlet 116 and the coupling member 116'.

The rotatable inlet cylinder 114 is rotatable about the longitudinal axis A to allow the inlet 112 to be arranged at any suitable rotatable position about the longitudinal axis A to facilitate coupling of the refrigerant line 20 to the inlet 112. The rotatable inlet cylinder 114 is between the inlet end 122 of the housing 120 and an inverter 130. The inverter 130 is any suitable power inverter for changing direct current to alternating current for powering a motor 150. The inverter 130 is mounted at the housing 120 in any suitable manner to compress the rotatable inlet cylinder 114 between the inverter 130 and the housing 120. When the connection between the inverter 130 and the housing 120 is loosened (e.g., fasteners coupling the inverter 130 to the housing 120 are loosened) the inverter 130 does not apply compression force against the rotatable inlet cylinder 114, and thus the rotatable inlet cylinder 114 is free to rotate about the longitudinal axis A. When the connection between the inverter 130 and the housing 120 is tightened, the inverter 130 is drawn towards the housing 120 along the longitudinal axis A to apply compression force against the rotatable inlet cylinder 114 thereby preventing the rotatable inlet cylinder 114 from rotating.

Figure 3:
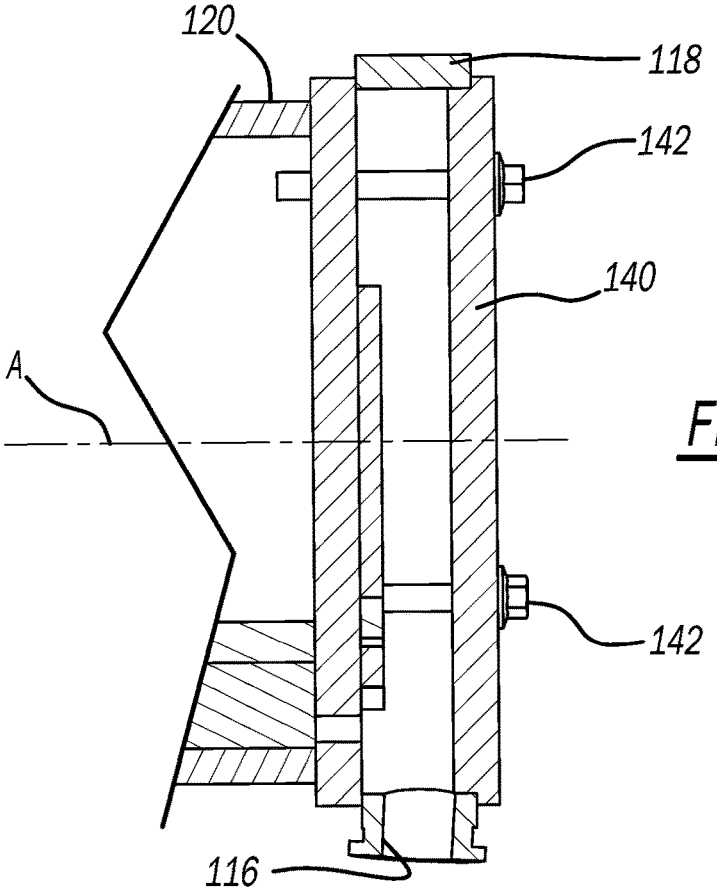
FIG. 3 is a cross-sectional view of the compressor of FIG. 1 taken along line 3-3 of FIG. 2.

With reference to FIG. 3, the rotatable outlet cylinder 118 is between the housing 120 and a seal plate 140. The seal plate 140 is fastened to the housing with any suitable fasteners 142. When the seal plate 140 is tightened against the housing 120 by the fasteners 142, the seal plate 140 presses against the rotatable outlet cylinder 118 to restrict rotation of the rotatable outlet cylinder 118. When the fasteners 142 are loosened, the seal plate 140 will apply a reduced amount of compression force (or little to no compression force) against the rotatable outlet cylinder 118 thereby allowing the rotatable outlet cylinder 118 to rotate about the longitudinal axis A, which allows the outlet 116 to be positioned at any suitable position about the longitudinal axis A to facilitate coupling of the outlet 116 to the refrigerant line 20.

Figure 4:
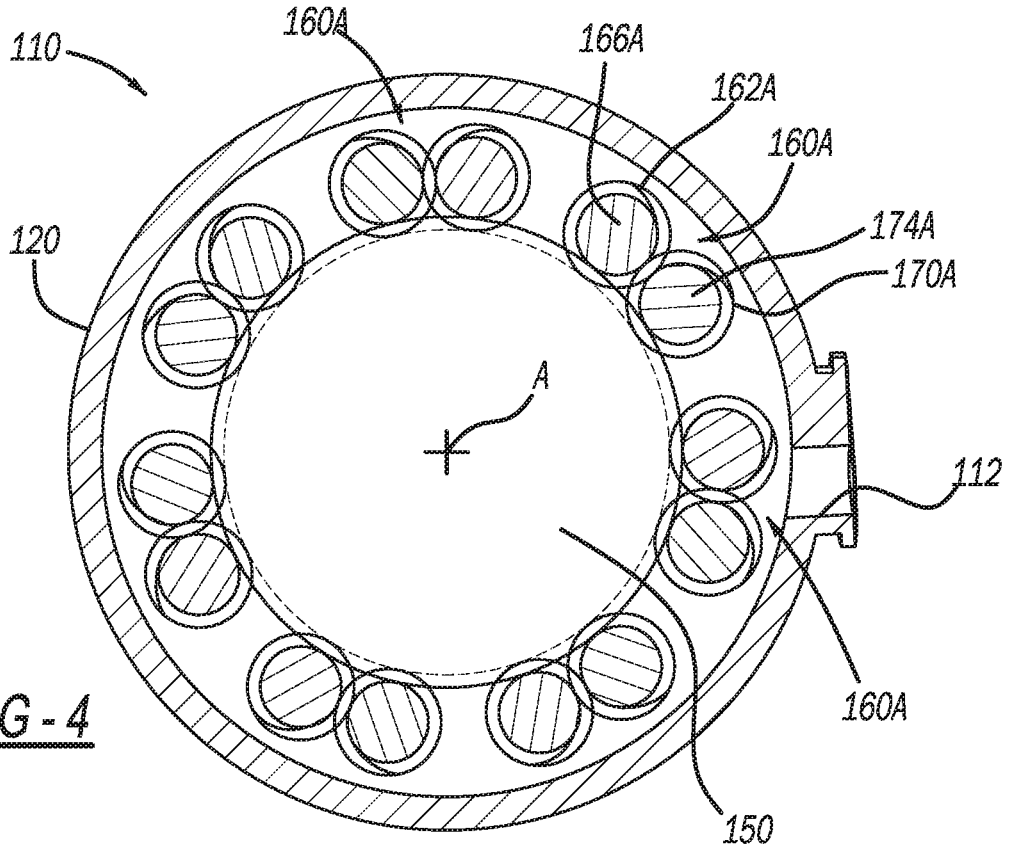
FIG. 4 is a cross-sectional view of the compressor of FIG. 1 taken along line 4-4 of FIG. 1.

With renewed reference to FIG. 2 and additional reference to FIG. 4, seated within the housing 120 along the longitudinal axis A is a motor 150. The motor 150 can be any motor suitable for rotating screw sets 160A, such as any suitable electric motor. The screw sets 160A are arranged about the motor 150 and the longitudinal axis A, as illustrated in FIG. 4, for example. Any suitable number of screw sets 160A may be included, such as seven screw sets as illustrated in FIG. 4. The screw sets 160A may be evenly spaced apart from one another.

Figure 5:
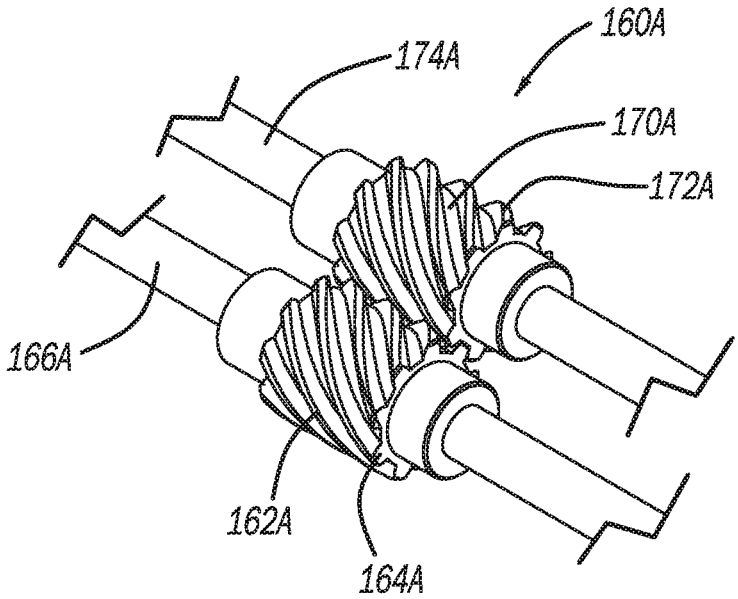
FIG. 5 illustrates an exemplary helical screw set in accordance with the present disclosure for the compressor of FIG. 1.

With additional reference to FIG. 5, the screw sets 160A each include a first screw or rotor 162A having threads 164A. The first screw 162A is rotated by a first rod 166A. The first screw 162A is in cooperation with a second screw 170A having threads 172A. The threads 172A are in close cooperation with the threads 164A to compress refrigerant therebetween. The second screw 170A is rotated by second rod 174A. Refrigerant flowing into the compressor 110 through the inlet 112 flows between the first and second screws 162A and 170A, and is compressed therebetween. The threads 164A and the threads 172A generally mesh with one another (i.e., in a male/female rotor configuration).

With renewed reference to FIG. 2, each one of the first and second rods 166A and 174A have screw gears 180 at the ends thereof. The screw gears 180 mesh with drive gears 182, which are meshed with motor gears 152 of the motor 150. Thus the motor 150 rotates motor gears 152, which rotate drive gears 182, which rotate screw gears 180 of the screw sets 160A in order to rotate the first and second screws 162A and 170A and compress refrigerant therebetween.

Figure 6:
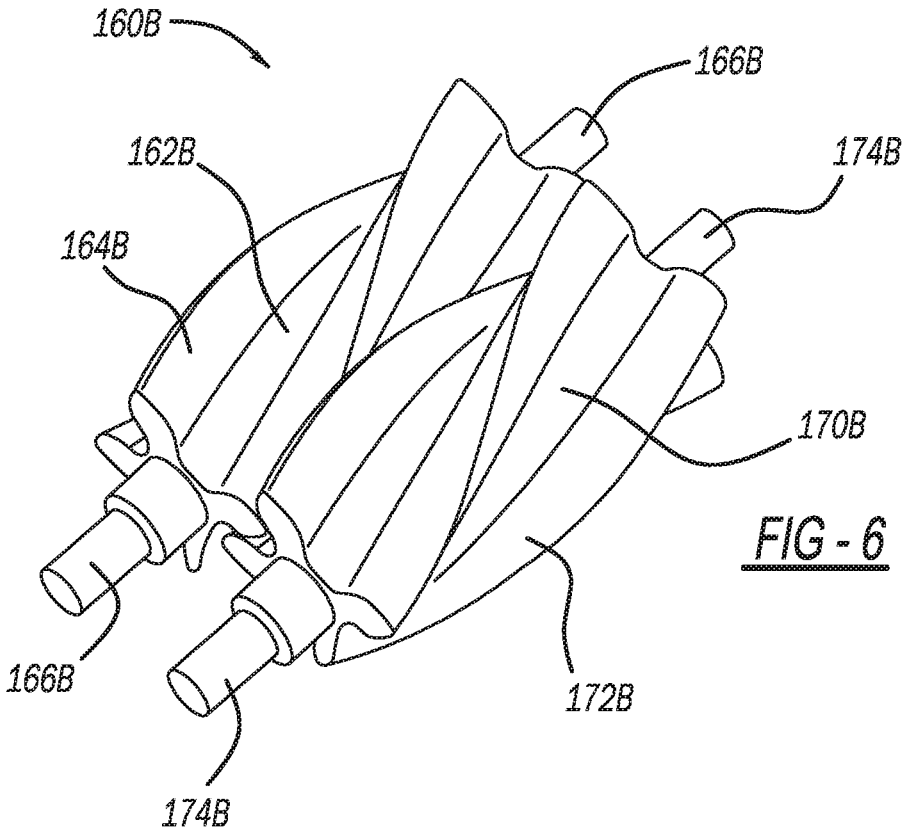
FIG. 6 illustrates another exemplary helical screw set in accordance with the present disclosure for the compressor of FIG. 1.

The screw set 160A is merely an exemplary screw set, and thus any other suitable screw sets may be included. For example and as illustrated in FIG. 6, screw sets 160B may be included in place of the screw sets 160A. Screw sets 160B are substantially similar to screw sets 160A, and thus the similar components are illustrated with the same reference numerals but having the suffix "B" instead of the suffix "A." The description of these common features set forth above with respect to the description of screw set 160A also applies to the screw set 160B. As illustrated in the drawings, the threads 164B and 172B of the screw set 160B have a different shape as compared to the threads 164A and 172A of the screw set 160A.

Figure 7:
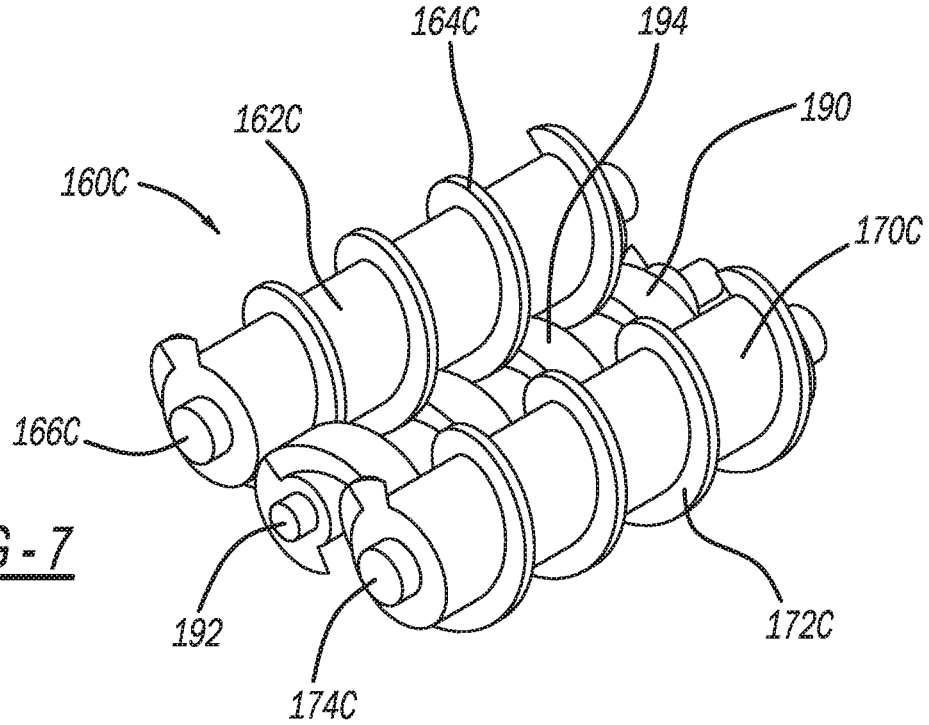
FIG. 7 illustrates an additional exemplary helical screw set in accordance with the present disclosure for the compressor of FIG. 1.

FIG. 7 illustrates another exemplary screw set at 160C. Features of the screw set 160C that are similar to the screw sets 160A and 160B are illustrated in FIG. 7 using the same reference numbers, but with the suffix "C." The description of the common features set forth above also applies to the screw set 160C. Unlike the screw sets 160A and 160B, the screw set 160C includes a center screw/rotor 190 rotated by a center rod 192. The center screw 190 includes threads 194, which are in cooperation with the threads 164C and the threads 172C. Refrigerant is compressed between the first screw 162C and the center screw 190, as well as between the second screw 170C and the center screw 190.

The present disclosure thus provides numerous advantages over prior HVAC compressors. For example, the rotation of the screw sets 160A, 160B, 160C by the motor 150 is quieter than other types of compressors, such as reciprocal compressors. Furthermore, the temperature increase of the refrigerant during the compression by the helical screw sets 160A, 160B, 160C is far less than the temperature increase caused by piston reciprocal compressors. Because the compression process of the rotary screw sets 160A, 160B, 160C is a continuous sweeping motion, there is very little pulsation or spill-back, which is in contrast to current piston compressors. Still further, there is no source of friction or large inertia to overcome, so the rotary screw sets 160A, 160B, 160C do not have a high level of overload requirements. Also, by arranging the motor 150 along the longitudinal axis A and the screw sets 160A, 160B, 160C about the motor 150, the compressor 110 can advantageously be made shorter, thereby saving valuable vehicle space.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A screw compressor for a heating, ventilation, and air conditioning (HVAC) system, the screw compressor comprising:

a housing having an inlet end and an outlet end for refrigerant to pass into and out of the housing;

a motor within the housing; and a plurality of screw sets arranged about the motor, the screw sets receive the refrigerant entering through the inlet end, compress the refrigerant between meshed rotors of the plurality of screw sets, and direct the refrigerant out of the housing through the outlet end of the housing;

wherein the motor is at a center of the plurality of screw sets.

2. The screw compressor of claim 1, wherein the motor is arranged along a longitudinal axis of the housing that extends from the inlet end to the outlet end along an axial center of the housing.

3. The screw compressor of claim 1, wherein the plurality of screw sets are spaced apart about the motor.

4. The screw compressor of claim 1, further comprising:

a rotatable inlet cylinder at the inlet end of the housing having an inlet for the refrigerant to pass into the rotatable inlet cylinder and then into the housing through the inlet end of the housing; and a rotatable outlet cylinder at the outlet end of the housing having an outlet for the refrigerant that has passed through the housing to exit the rotatable outlet cylinder.

5. The screw compressor of claim 1, further comprising:

a seal plate mounted at the rotatable outlet cylinder such that the rotatable outlet cylinder is between the seal plate and the housing;

wherein:

the seal plate restricts rotation of the rotatable outlet cylinder when the seal plate is pressed against the rotatable outlet cylinder; and the rotatable outlet cylinder is free to rotate when the seal plate is loosened and not pressed against the rotatable outlet cylinder.

6. The screw compressor of claim 1, further comprising:

an inverter mounted at the rotatable inlet cylinder such that the rotatable inlet cylinder is between the inverter and the housing;

wherein:

the inverter restricts rotation of the rotatable inlet cylinder when the inverter is pressed against the rotatable outlet cylinder; and the rotatable inlet cylinder is free to rotate when the inverter is loosened and not pressed against the rotatable inlet cylinder.

7. A screw compressor for a heating, ventilation, and air conditioning (HVAC) system, the screw compressor comprising:

a housing having an inlet end and an outlet end;

a rotatable inlet cylinder at the inlet end of the housing having an inlet for refrigerant to pass into the rotatable inlet cylinder and then into the housing through the inlet end of the housing;

a rotatable outlet cylinder at the outlet end of the housing having an outlet for the refrigerant that has passed through the housing to exit the rotatable outlet cylinder;

a motor within the housing, the motor is arranged along a longitudinal axis of the housing and extends along an axial center of the housing; and a plurality of screw sets rotated by the motor, the screw sets compress the refrigerant between meshed screws of each screw set, the screw sets are equidistant to the longitudinal axis;

wherein the plurality of screw sets surround the motor.

8. The screw compressor of claim 7, wherein the motor is an electric motor.

9. The screw compressor of claim 7, wherein the motor is at a center of the plurality of screw sets.

10. The screw compressor of claim 7, wherein the plurality of screw sets are evenly spaced about the motor.

11. The screw compressor of claim 7, further comprising drive gears in cooperation with a motor gear of the motor and the plurality of screw sets such that rotation of the motor gear driven by the motor rotates the drive gears, and rotation of the drive gears rotates the plurality of screw sets.

12. The screw compressor of claim 7, wherein at least some of the plurality of screw sets include a male rotor meshed with a female rotor.

13. The screw compressor of claim 7, wherein at least some of the plurality of screw sets include a center rotor that is between and meshed with both a first side rotor and a second side rotor.

14. The screw compressor of claim 7, wherein the inlet of the inlet cylinder is rotatable.

15. The screw compressor of claim 7, wherein the outlet of the outlet cylinder is rotatable.

16. The screw compressor of claim 7, further comprising a seal plate mounted at the rotatable outlet cylinder such that the rotatable outlet cylinder is between the seal plate and the housing.

17. The screw compressor of claim 16, wherein the seal plate restricts rotation of the rotatable outlet cylinder when the seal plate is pressed against the rotatable outlet cylinder; and wherein the rotatable outlet cylinder is free to rotate when the seal plate is loosened and not pressed against the rotatable outlet cylinder.

18. The screw compressor of claim 7, further comprising an inverter mounted at the rotatable inlet cylinder such that the rotatable inlet cylinder is between the inverter and the housing.

19. The screw compressor of claim 18, wherein the inverter restricts rotation of the rotatable inlet cylinder when the inverter is pressed against the rotatable outlet cylinder; and wherein the rotatable inlet cylinder is free to rotate when the inverter is loosened and not pressed against the rotatable inlet cylinder.

20. A screw compressor for a heating, ventilation, and air conditioning (HVAC) system, the screw compressor comprising:

a housing having an inlet end and an outlet end;

a rotatable inlet cylinder at the inlet end of the housing having an inlet for refrigerant to pass into the rotatable inlet cylinder and then into the housing through the inlet end of the housing;

a rotatable outlet cylinder at the outlet end of the housing having an outlet for the refrigerant that has passed through the housing to exit the rotatable outlet cylinder;

a motor within the housing, the motor is arranged along a longitudinal axis of the housing and extends along an axial center of the housing;

a plurality of screw sets rotated by the motor, the screw sets compress the refrigerant between meshed screws of each screw set, the screw sets are equidistant to the longitudinal axis; and drive gears in cooperation with a motor gear of the motor and the plurality of screw sets such that rotation of the motor gear driven by the motor rotates the drive gears, and rotation of the drive gears rotates the plurality of screw sets.

* * * * *